US010501250B2

(12) United States Patent
Varbanov

(10) Patent No.: US 10,501,250 B2
(45) Date of Patent: Dec. 10, 2019

(54) FLEXIBLE POUCH WITH A LARGER OPENING

(71) Applicant: NESTEC S.A., Vevey (CH)

(72) Inventor: Petar Varbanov, Bulle (CH)

(73) Assignee: SOCIÉTÉ DES PRODUITS NESTLÉ S.A., Vevey (CH)

( * ) Notice: Subject to any disclaimer, the term of this patent is extended or adjusted under 35 U.S.C. 154(b) by 271 days.

(21) Appl. No.: 14/654,297

(22) PCT Filed: Dec. 19, 2013

(86) PCT No.: PCT/EP2013/077512
§ 371 (c)(1),
(2) Date: Jun. 19, 2015

(87) PCT Pub. No.: WO2014/096270
PCT Pub. Date: Jun. 26, 2014

(65) Prior Publication Data

US 2015/0329259 A1 Nov. 19, 2015

(30) Foreign Application Priority Data

Dec. 20, 2012 (EP) ..... 12198357

(51) Int. Cl.

| | |
|---|---|
| ***B65D 77/06*** | (2006.01) |
| ***B65D 25/16*** | (2006.01) |
| ***B65B 1/04*** | (2006.01) |
| ***B65B 51/10*** | (2006.01) |
| ***B65D 75/00*** | (2006.01) |
| ***B65D 30/10*** | (2006.01) |

(52) U.S. Cl.
CPC ..... *B65D 77/06* (2013.01); *B65B 1/04* (2013.01); *B65B 51/10* (2013.01); *B65D 25/16* (2013.01); *B65D 31/16* (2013.01); *B65D 75/008* (2013.01)

(58) Field of Classification Search
CPC ..... B65D 77/06; B65D 25/16; B65D 31/16; B65D 75/008; B65B 1/04; B65B 51/10
USPC ..... 220/9.1, 495.03, 495.06, 9.3; 383/119, 383/104, 122, 121, 107; 493/218
See application file for complete search history.

(56) References Cited

U.S. PATENT DOCUMENTS 3,380,646 A 4/1968 Doyen et al.
4,041,851 A * 8/1977 Jentsch ..... B29C 66/1122 493/200
4,261,253 A 4/1981 Smith, II
(Continued)

FOREIGN PATENT DOCUMENTS

DE 29513879 U1 2/1997
EP 0578195 1/1994
(Continued)

*Primary Examiner* — Kareen K Thomas

(57) ABSTRACT

The present invention relates to a flexible pouch (1) having a wider opening (2) allowing to get a better access of the content of the pouch (1). The perimeter (a) of the opening (2) of the flexible pouch (1) is greater than the perimeter (b) of its bottom (3). At least one of the lateral folding lines (5) of the flexible pouch (1) comprises a welding line (6) of a width (w). A part or all of the lateral welding lines (6) of the flexible pouch (1) have a width (w) which is not constant along its length. The invention also relates to a kit-of-part comprising the flexible pouch (1) according to the invention and a container (14) adapted to receive said flexible pouch (1).

21 Claims, 9 Drawing Sheets

(56) References Cited

U.S. PATENT DOCUMENTS

| | | | | |
|---|---|---|---|---|
| 4,779,998 | A | 10/1988 | Wischusen, III | |
| 5,375,930 | A | 12/1994 | Tani | |
| 5,772,332 | A | 6/1998 | Geller | |
| 6,036,365 | A * | 3/2000 | Imer | B65D 31/08 383/104 |
| 6,231,237 | B1 * | 5/2001 | Geller | B29C 65/18 220/9.1 |
| D502,390 | S * | 3/2005 | Ouchi | D9/705 |
| 2008/0131035 | A1 * | 6/2008 | Rogers | B65D 75/5827 383/203 |
| 2011/0142378 | A1 * | 6/2011 | Samadijavan | B65D 88/1612 383/117 |
| 2011/0229060 | A1 * | 9/2011 | Koesters | B65D 33/10 383/21 |
| 2013/0130878 | A1 | 5/2013 | Nakagawa et al. | |

FOREIGN PATENT DOCUMENTS

| | | | |
|---|---|---|---|
| EP | 0994039 | A1 | 4/2000 |
| EP | 1947023 | | 7/2008 |
| GB | 2081214 | A | 2/1982 |
| WO | 0018650 | | 4/2000 |
| WO | 0154998 | | 8/2001 |
| WO | 2005035388 | | 4/2005 |
| WO | 2012040145 | | 3/2012 |
| WO | 2012085117 | A1 | 6/2012 |
| WO | 2012154655 | A1 | 11/2012 |

* cited by examiner

FLEXIBLE POUCH WITH A LARGER OPENING

CROSS REFERENCE TO RELATED APPLICATIONS

The present application is a National Stage of International Application No. PCT/EP2013/077512, filed on Dec. 19, 2013, which claims priority to European Patent Application No. 12198357.1, filed on Dec. 20, 2012, the entire contents of which are being incorporated herein by reference.

FIELD OF THE INVENTION

The present invention relates to a flexible pouch having a larger opening, allowing a better accessibility to its content. The flexible pouch can enclose various types of product and particularly dried food products and powders such as cereals, infant cereals, infant formula and powdered beverages.

The present invention also relates to a kit-of-part comprising the flexible pouch according to the invention and a container adapted to receive said flexible pouch.

BACKGROUND OF THE INVENTION

Packagings for food products fulfil several functions. They not only allow to condition, transport, store and distribute food products to the consumers in a safe, hygienic and convenient way, but they also provide with a visual support for commercial advertisement.

The existing packagings are very varied both in terms of material constituents and shapes. The most common ones are rigid boxes that are made of cardboard, rigid plastic or metal such as steel. They can have several sides and they are generally of regular shape, such as a rectangular (parrallepipedic) shape. However this shape limitation has some inconvenients since it is difficult to access to the content of said boxes due to the rigidity of the packagings. Some irregular shapes (e.g. trapezoidal) have also been developed in order to offer a wider opening and therefore a better access to the content of the packagings. However these packagings also have major drawbacks such as higher production costs (since more materials are needed to get this specific enlarged shape), manufacturing constraints, but also storing and transportation constraints due to these irregular shapes.

Alternatively, flexible pouches or packages have been used since decades for food and beverages retail. Such pouches are made with flexible material such as a plastic film, paper and/or aluminium. One of the main advantages of the flexible pouches is that generally fewer materials are needed in comparison with the rigid packagings since the content of the pouches is more accessible due to the flexibility of these packagings. They are therefore less expensive in terms of material constituents and less heavy. On the other hand, the most common technology to produce these pouches is Vertical form-Fill-Seal (VFFS), which brings some limitations to the possibilities of shapes since the final pouch is vertical and its bottom has the same perimeter as its opening. Another major drawback of the standard flexible pouches is that they generally do not stand up independently upright due to the nature of their constituents and therefore do not offer a convenient accessibility of the food product to the consumers. Therefore several types of stand-up pouches have been developed. EP1947023 discloses a particular flat bag type storage bag, including a three-sided bag, a twofold bag and a two-sided bag which enables self-supporting after content storage. U.S. Pat. No. 5,772,332 describes a container made of flexible film sheets that have essentially a rectangular base. EP334242 describes a stand-up plastic bag which comprises two side walls and a curved bottom. WO2008150736 describes a stand-up package with four sides allowing an easy dispensing of the products, in particular granular or powdery products. EP1305224 describes a stand-up bag of heat-sealable plastic film comprising side seams and a bottom wall folded inwards into V-shape. These packages have the advantages to provide a suitable stability of the packaging.

Typically, the consumers open the stand-up pouches made of flexible material either by tearing or ripping one sealed extremity. Once opened, the consumers can reach the product and the pouch stably stands up even once emptied. However, the product accessibility is substantially decreased when the level of the product in the pouch decreases. Indeed, the opening is relatively narrow and the consumers cannot easily introduce their hands or any device to extract the product out of the pouch. Moreover, while tempting to extract the product near the bottom of the pouch, the pouch can fold on itself, thereby narrowing even more the opening of the pouch and impairing a complete recovery of the content of the pouch. It is particularly true for powdered products when using a scoop for example.

There is therefore a need to develop a flexible pouch which allows a better accessibility to its content whatever the level of the product enclosed into the pouch, providing the right balance between accessibility and stability of the package when it stands upright, without impairing the process efficiency in terms of quantity of materials used for the manufacturing, production costs, sustainability, storing and transportation.

OBJECT OF THE INVENTION

It is therefore an object of the present invention to provide a flexible pouch with a larger opening, allowing a better accessibility of its content without increasing the quantity of materials used for its manufacturing and that can still be manufactured using the Vertical form-Fill-Seal (VFFS) technology. The perimeter of the opening of the pouch is greater (i.e. larger) than the perimeter of the bottom of the pouch. This may be obtained because at least one of the lateral welding lines of the pouch has a width which is not constant along its length, and said variation of the width could be regular or irregular.

In some embodiments the pouch according to the invention has a conical shape or a funnel shape, especially when it is in open position.

In addition, the invention discloses a kit comprising the combination of the flexible pouch of the invention and a container, the shape of the container being adapted to receive the pouch even when this one is in the open position.

The present invention therefore provide some alternatives to the prior art and in particular a flexible pouch and a kit providing an easy access to the content of the pouch and a safe storage of the product, without impairing the process efficiency in terms of quantity of materials used for the manufacturing, production costs, sustainability and transportation.

SUMMARY OF THE INVENTION

Thus, a first object of the invention is a flexible pouch comprising an opening with a perimeter (a), a bottom with a perimeter (b), at least two side walls, at least two lateral folding lines, at least one of these lateral folding lines comprising a welding line of a width (w), characterized in that said perimeter (a) is greater than said perimeter (b), and in that a part or all of the lateral welding lines of the flexible pouch have a width (w) which is not constant along its length.

It is noted that the various aspects, features, examples and embodiments described in the present application may be compatible and/or combined together.

In a particular embodiment the perimeter (a) is greater than the perimeter (b) especially when the flexible pouch is in the open position. In some embodiments, the perimeter (a) is greater than the perimeter (b) only when the flexible pouch is open and not when the flexible pouch is closed.

The number of side walls of the flexible pouch is variable, e.g. at least 2, at least 3, at least 4, at least 5, at least 6, at least 7 or at least 8 side walls. The flexible pouch can therefore have 2, 3, 4, 5, 6, 7, 8 or even more side walls.

The number of lateral folding lines is also variable, e.g. at least 2, at least 3, at least 4, at least 5, at least 6, at least 7 or at least 8 lateral folding lines. It is dependent on (or equal to) the number of side walls of the flexible pouch as the lateral folding lines correspond to the edges of the side walls extending from the opening to the bottom. The flexible pouch can therefore have 2, 3, 4, 5, 6, 7, 8 or even more lateral folding lines.

The number of lateral welding lines (i.e. the number of lateral folding lines comprising a welding line) is also variable, e.g. at least 1, at least 2, at least 3, at least 4, at least 5, at least 6, at least 7 or at least 8 lateral welding lines. In other terms at least 1, at least 2, at least 3, at least 4, at least 5, at least 6, at least 7 or at least 8 of the lateral folding lines of the flexible pouch can comprise a welding line. The number of lateral welding lines is not dependent on the number of side walls or on the number of lateral folding lines. This means that either a part (1, 2, 3, 4, 5 . . . or a quarter, a third, half, two thirds, three quarters, a sixth, five sixth . . . ) of the lateral folding lines of the flexible pouch or all of them can comprise a welding line. At least one lateral welding line is needed, i.e. at least one of the lateral folding lines of the flexible pouch should comprise a welding line to provide a certain stability of the flexible pouch. It may help the pouch to stand-up. In a particular embodiment the pouch has at least 2 lateral welding lines for a better stability. The higher the number of lateral welding lines is, the more stable the flexible pouch is. The pouch can therefore have 1, 2, 3, 4, 5, 6, 7, 8 or even more lateral welding lines. In other terms 1, 2, 3, 4, 5, 6, 7, 8 or even more of the lateral folding lines of the flexible pouch can comprise a welding line.

In a particular embodiment all the lateral folding lines of the pouch comprise a welding line; in other words, the number of the lateral welding lines is identical to the number of lateral folding lines.

In a specific embodiment the flexible pouch has two side walls, two lateral folding lines and one lateral welding line as defined in the present invention (i.e. only one of the lateral folding lines comprises a welding line).

In another embodiment, the flexible pouch has two side walls, two lateral folding lines and two lateral welding lines as defined in the present invention (i.e. all the lateral folding lines comprise a welding line).

In another embodiment the flexible pouch has four side walls, four lateral folding lines and at least one lateral welding line as defined in the present invention, e.g. one, two, three or four lateral welding lines, i.e. a quarter (1), half (2), three quarters (3) or all (4) of the lateral folding lines comprise(s) a welding line. In a specific embodiment the flexible pouch has four side walls, four lateral folding lines and one lateral welding line as defined in the present invention (i.e. a quarter of the lateral folding lines comprise a welding line).

In a specific embodiment the flexible pouch has four side walls, four lateral folding lines and two lateral welding lines as defined in the present invention (i.e. half of the lateral folding lines comprise a welding line).

In a specific embodiment the flexible pouch has four side walls, four lateral folding lines and three lateral welding lines as defined in the present invention (i.e. three quarters of the lateral folding lines comprise a welding line).

In a particular embodiment the flexible pouch has four side walls, four lateral folding lines and four lateral welding lines as defined in the present invention (i.e. all (4) the lateral folding lines comprise a welding line).

In another embodiment the flexible pouch has six side walls, six lateral folding lines and at least one lateral welding line as defined in the present invention, e.g. one, two, three, four, five, six lateral welding lines (i.e. one (a sixth), two (a third), three (half), four (two thirds), five (five sixth) or all of the lateral folding lines comprise(s) a welding line).

In a specific embodiment the flexible pouch has six side walls, six lateral folding lines and six lateral welding lines as defined in the present invention (i.e. all the lateral folding lines comprise a welding line).

A skilled man can easily define a suitable width (w) for the lateral welding line of the flexible pouch depending on the needs. The width (w) of the lateral welding line can for example be comprised between 0.05 and 30 mm, or from 0.1 and 25 mm, or from 1 and 20 mm, or from 1.5 and 15 mm, or from 2 and 10 mm, or from 2.5 and 8 mm, or from 3 and 6 mm. In a particular embodiment the lateral welding line has a width (w) of 5 mm.

As previously mentioned, a part or all of the lateral welding lines of the flexible pouch have a width (w) which is not constant along its length, i.e. the width (w) of the lateral welding line is varying.

Therefore at least one of the lateral welding lines has a width (w) which is not constant along its length. In different particular embodiments, a part or all the lateral welding lines of the flexible pouch have a width (w) which is not constant along its/their length.

Depending on the embodiments the flexible pouch can have at least one, at least two, at least three, at least four, at least five, at least six lateral welding lines with a width (w) which is not constant along its/their length, e.g. one, two, three, four, five, six or even more lateral welding lines with a width (w) which is not constant along its/their length.

In a particular embodiment at least two lateral welding lines as defined in the present application have a width (w) which is not constant along their length. In some embodiments, the flexible pouch has two, three, four or six lateral welding lines with a width (w) which is not constant along their length. In a specific embodiment all the lateral welding lines of the flexible pouch have a width (w) which is not constant along their length.

In addition, the lateral welding lines can have a similar or a different varying width (w) i.e. when compared each others. So each lateral welding line can have a similar or a different varying width (w). In other words, the width (w) can vary similarly or differently amongst each of the lateral welding lines.

In a particular embodiment at least one lateral welding line of the flexible pouch has a width (w1) near the bottom which is larger than the width (w2) near the opening. The width (w1) can be similar to the width (w). The width (w1) can therefore be comprised between 0.05 and 30 mm, or from 0.1 and 25 mm, or from 1 and 20 mm, or from 1.5 and 15 mm, or from 2 and 10 mm, or from 2.5 and 8 mm, or from 3 and 6 mm. In a particular embodiment (w1) is 5 mm.

The width (w2) is smaller than the width (w1). It is generally lower than 20 mm, or lower than 15 mm, or lower than 10 mm, or lower than 6 mm, or lower than 4 mm, or lower than 2 mm. It can be from 0 to 2 mm or from 0.01 to 1 mm or from 0.1 to 0.5 mm. In a particular embodiment the width (w2) is zero or close to zero.

Varying the width of the lateral welding line(s) of the flexible pouch allows getting a larger opening without having any increase of the material constituents, therefore without any costs impacts. This provides convenient packaging with optimized barrier property and accessibility.

In several embodiments the enclosed volume of the flexible pouch may also be increased. The enclosed volume may have a conical shape or a funnel shape.

In addition, the variation of the width (w) can be regular or irregular along its length. Therefore at least one of the lateral welding lines of the flexible pouch has a width (w) that varies regularly or irregularly along its length. A part or all of the lateral welding lines can be involved. A proportional decrease of the width from the bottom to the opening is an example of regular variation of the width (w).

In some embodiments, one, two, three, four, five, six, seven, eight or more of the lateral welding lines of the flexible pouch has/have a width (w) that varies regularly or irregularly along its/their length.

In some embodiments the flexible pouch can have at least one (1, 2, 3, 4, 5, 6 . . . ) lateral welding line with a width (w) that varies regularly along its length and at least one (1, 2, 3, 4, 5, 6 . . . ) lateral welding line with a width (w) that varies irregularly along its length.

In a specific embodiment at least one of the lateral welding lines has an interruption between the opening and the bottom of the flexible pouch and at a distance (c) from said opening. In this embodiment the width (w2) is zero or close to zero.

A part or all of the lateral welding lines can have an interruption. The flexible pouch can have at least one, at least two, at least three, at least four, at least five, at least six lateral welding lines with an interruption e.g. one, two, three, four, five, six or even more lateral welding lines with an interruption. In a specific embodiment the flexible pouch has four lateral welding lines and all of them have an interruption.

In addition each lateral welding line can have an interruption located at a similar or at a different distance (c). So when the flexible pouch have several lateral welding lines with an interruption, the distances (c) can be of a similar or of a different length, but these interruptions are typically located at a similar distance (c).

In a specific embodiment the flexible pouch according to the invention comprises at least two shoulders. It can have at least two, at least three, at least four, at least five, at least six shoulders depending on the embodiments, e.g. two, three, four, five, six or even more shoulders. The number of shoulders is typically equal to the number of side walls of the flexible pouch. In a particular embodiment the flexible pouch has four side walls and four shoulders. The shoulders are located at a distance (e) from the opening of the flexible pouch, along the lateral folding line(s). The shoulders are typically proximal from the opening of the flexible pouch. They especially participate to the closure of the flexible pouch. The distance (e) is shorter than the distance (d) which is the total distance from the opening to the bottom of the flexible pouch (it also corresponds to the length of the lateral folding line).

The distance (e) can represent from 1 to 99% of the distance (d), more typically from 5 to 80% of the distance (d), more typically from 10 to 60% of the distance (d), more typically from 12.5% (i.e. a eighth) to 50% (i.e. half) of the distance (d), more typically from 25 (i.e. a quarter) to 50% (i.e. half) of the distance (d). In a particular embodiment the distance (e) is 25% of the distance (d). In another particular embodiment the distance (e) is 50% of the distance (d).

The distances (e) of the different shoulders can be of a similar or of a different length, but they are typically similar.

As previously mentioned the number of shoulders is typically the same as the number of side walls, even if it might be different.

In a specific embodiment the flexible pouch comprises an opening with a perimeter (a), a bottom with a perimeter (b), said perimeter (a) being greater than said perimeter (b), four side walls, four lateral folding lines, four lateral welding lines, all of them having an interruption, and four shoulders located at a similar distance (e).

The distance (c) can be similar, greater or smaller than the distance (e) depending on the embodiments. But both distances (c) and (e) are shorter than the distance (d). So $e \leq c < d$ or $c \leq e < d$.

The skilled man will easily define and adapt the length of the distances (c), (d) and (e) depending on the flexible pouch he needs. In some particular examples, the distances (c) and (e) can be from 1 to 15 cm, more typically from 2 to 10 cm, more typically from 3 to 6 cm, and the distance (d) can be from 5 to 100 cm, more typically from 10 to 50 cm, more typically from 15 to 25 cm.

In the present invention the perimeter (a) of the opening is greater than the perimeter (b) of the bottom. This wider opening of the flexible pouch allows the consumers to have a better access to the content of the pouch. The skilled man will easily define and adapt the length of the perimeters (a) and (b) depending on the pouch he needs. By way of example only, these perimeters can be from 20 cm to 200 cm, from 30 cm to 140 cm, from 40 cm to 100 cm or from 40 cm to 70 cm, provided that (a) is greater than (b).

The ratio of the perimeter (a) over the perimeter (b) may be comprised in a range from 1.01 to 2, from 1.02 to 1.7, from 1.05 to 1.5, from 1.1 to 1.4, or from 1.1 to 1.25.

In a particular example the flexible pouch has four side walls, four lateral folding lines, four lateral welding lines with a width (w1) of 5 mm and a width (w2) of 0 mm or close to 0 mm, a parameter (b) of 40 cm and a parameter (a) of 44 cm (so a ratio (a) over (b) of 1.1).

The opening of the flexible pouch may be closed or hermetically closed. The consumers can easily open the flexible pouch when he needs to access to the content, then he can close it when he does not need any more product.

The person skilled in the art knows the various closing systems that can be used. By way of examples only, the opening of the flexible pouch can be closed with any closing means (e.g. closing elements) selected from the group consisting of a transversal welding line, a gusset formed by folding the top of the pouch, a zip, some reclose strips, a sticker or any combinations thereof. In a particular example the transversal welding line is formed by at least two flaps (2, 3, 4, 5, 6 or even more, depending on the embodiments) that are hermetically sealed together, the sealing being typically provided by a heat sealing, a gluing or the like. In a specific embodiment, the flexible pouch may comprise four side walls and the top has only two flaps sealed together.

In a particular example the flexible pouch may comprise four side walls, four shoulders and the top may be folded into a gusset formed by folding horizontally the top of the flexible pouch (i.e. the top of the side walls and the top of the lateral folding lines are folded e.g. at the shoulders). As previously mentioned the shoulders will help to the closure of the flexible pouch. A transversal welding line could hermetically seal the opening. Then, when the consumer wants to reclose the flexible pouch, he may fold the top of the flexible pouch on itself.

As previously mentioned the flexible pouch according to the invention is typically a stand-up pouch. To improve its stability the flexible pouch can contain any means (e.g. elements) well known by the skilled man that improve the stability of the pouch. The pouch can comprise a curved bottom as described for example in EP334242, a bottom gusset, a skirt (e.g. a rigid skirt) surrounding the bottom, some bottom welding lines, a bottom wall folded inwards into V-shape or any combinations thereof. In a specific embodiment the bottom of the flexible pouch comprises both a curved bottom and some bottom welding lines.

In some advantageous embodiments of the present invention, the flexible pouch is manufactured by VFFS (vertical form-fill-seal) technology.

In some embodiments, the flexible pouch is not made by HFFS (horizontal form-fill-seal) technology.

The flexible pouch can be designed in different manners depending on actual needs or preferences of the manufacturers.

The flexible pouch can have a trapezoidal shape for example, with a variable number of side walls.

In some embodiments, when the flexible pouch is in closed position it may have a regular shape (so all the folding lines will be parallel) such as a rectangular (parallepipedic) shape or an oval shape (e.g. Doy Pack), and when the flexible pouch is in open position it may have a different shape since the perimeter of the opening will be larger than the perimeter of the bottom. For example the flexible pouch can have a conical shape or a funnel shape when it is in open position. Therefore the enclosed volume may have a conical shape or a funnel shape.

In some embodiments the flexible pouch of the invention has a conical shape or a funnel shape only when it is in open position.

The flexible pouch can also comprise corner cuts and/or holes depending on the needs.

The pouch of the present invention is a flexible pouch. It is made of a flexible material such as a plastic film, paper, aluminium or any combinations thereof. In a specific embodiment the flexible material is not made of cardboard.

The flexible pouch of the present invention may be used in several areas. It can especially be used to store and/or dispense products. The flexible pouch can enclose various types of product such as dried products, especially dried food products. Non-limiting examples of dried food products include for instance all types of powdered or particulate products such as infant formula, infant cereals, soluble coffee, soluble coffee mixes, soluble tea, soluble chocolate powder for beverages, and any other powdered beverages; grocery products such as flour, oat flakes, breakfast cereals, sugar, rice, pasta, ground coffee, tea leaves; flaky products such as seasoning, or culinary powder.

Another object of the present invention is a kit of part comprising the flexible pouch of the present invention and a container adapted to receive it. The container comprises a base, an opening, at least two side walls and it can be closed with a lid. In a particular embodiment the container is adapted to receive the flexible pouch even when the pouch is open. Therefore in a specific embodiment the perimeter (f) of the base of said container is smaller than the perimeter (g) of the opening of said container. This allows the consumers to have a better access to the content of the flexible pouch according to the invention, even without putting the flexible pouch out of the container.

The skilled man will easily define and adapt the perimeters (f) and (g), depending on the needs and on the perimeters (a) and (b) of the flexible pouch. The perimeters (f) and (g) of the container will typically be larger than the perimeters (a) and (b) of the flexible pouch so that the flexible pouch can be placed into the container. By way of example only, (f) and (g) can be from 20.5 cm to 200.5 cm, from 30.5 cm to 140.5 cm, from 40.5 cm to 100.5 cm or from 40.5 cm to 70.5 cm, provided that (g) is greater than (f).

The shape of the container will depend on the characteristics of the flexible pouch. The container can therefore have two, three, four, five, six or even more side walls, depending on the embodiments.

The container can have various shapes, for example a conical shape, a funnel shape or a rectangular (parrallepipedic) shape.

In a normal process the container, especially when it is rigid, is obtained by injection moulding and therefore has a tendency to get a certain conical shape (obtained when the container is taken out of the injection mould). The integration of a flexible pouch having a conical or a funnel shape —especially when it is opened—is therefore much easier for the consumers than with the standard pouches, without impacting too much the manufacturing process of the container.

The container can be closed or hermetically closed with the lid. The container may comprise retaining means (e.g. retaining elements) for maintaining the lid in its position when it closes the container. A skilled person will know the various lids that can be used. For example the lid can be a separate piece that is added on the top of the container (i.e. at the opening). This one can be screwed or it can simply fit in the body of the container (defined by the at least two side walls) by complementarity of shapes. The lid can also be connected to the container by any linking means (e.g. linking elements) such as a hinge for example.

In a specific embodiment the container of the kit is rigid. It can be made for example with cardboard, plastic or metallic material.

In many advantageous embodiments of the invention, the flexible pouch of the invention is therefore made in materials that are more flexible that the container so that it can be easily handled.

In a particular embodiment when the flexible pouch is open into the container, the lid of the container can hermetically close said container without the need to reclose the pouch. This avoids hygiene issues as there is no prolonged contact of the content of the pouch with the air. This also allows an easiest access to the content of the pouch.

As previously mentioned, the flexible pouch of the invention may also comprise at least two flaps near the opening that can be sealed together to form a transversal welding line. In a particular embodiment, during the use of the kit, after the opening of the pouch of the invention, the flaps are folded around the distal ends of the at least two side walls and the closure is adapted to accommodate the distal ends of the side walls with the flaps folded around to provide a closure of the container with the pouch arranged internally, as described in WO2012/085117 herein incorporated by reference. In this embodiment an easy access to the content of the pouch may be obtained without necessary closing the opening of the flexible pouch, since a suitable closure is obtained by the lid.

The kit may be used in several manners. Typically, a consumer may purchase a pre-filled pouch and a container in an initial buy. The pouch may be arranged in the container or delivered separate from the container. Later, the consumer may only purchase the pouch and re-use the container. Although an advantageous effect of the invention is that the consumer may be provided with pre-filled pouches, the invention may also be utilised in a manner where e.g. the consumer purchase an empty pouch and fills the pouch with the desired substance themselves, or from a bulk container at the grocery for instance.

The kit may comprise securing means (e.g. securing elements) for fixing tightly the flexible pouch according to the invention to container, such as a knob, Velcro, reversible glue.

Another object of the present invention is the use of the flexible pouch of the present invention and/or the kit of part of the present invention to store and/or dispense products such as food products.

Another object of the present invention is a method to store and/or dispense products such as food products, the method comprising the step of using the flexible pouch of the present invention and/or the kit of part of the present invention.

Some examples of food products are previously mentioned. The flexible pouch or the kit can particularly be used to store and/or dispense dried food products such as infant formula, infant cereals, cereals and powdered beverages.

Another object of the present invention is the use of the flexible pouch according to the invention and/or the kit of part according to the invention to get a better access to the content of the flexible pouch, especially when the level of the product in the pouch decreases.

Another object of the present invention is a method to get a better access to the content of a flexible pouch, especially when the level of the product in the pouch decreases, the method comprising the step of using the flexible pouch of the invention and/or the kit of part of the invention.

BRIEF DESCRIPTION OF THE FIGURES

The invention and some particular embodiments thereof will now be described in more details with regard to the accompanying figures. The figures show manners of implementing the present invention and are not to be construed as being limiting to other possible embodiments falling within the scope of the attached claim set.

- 2A: proportional decrease of the width of the lateral welding line from the bottom to the opening
- 2B1 and 2B2: examples of interruption of the lateral welding line
- 2C1 and 2C2: examples of irregular variations of the width of the lateral welding line

Figure 1:
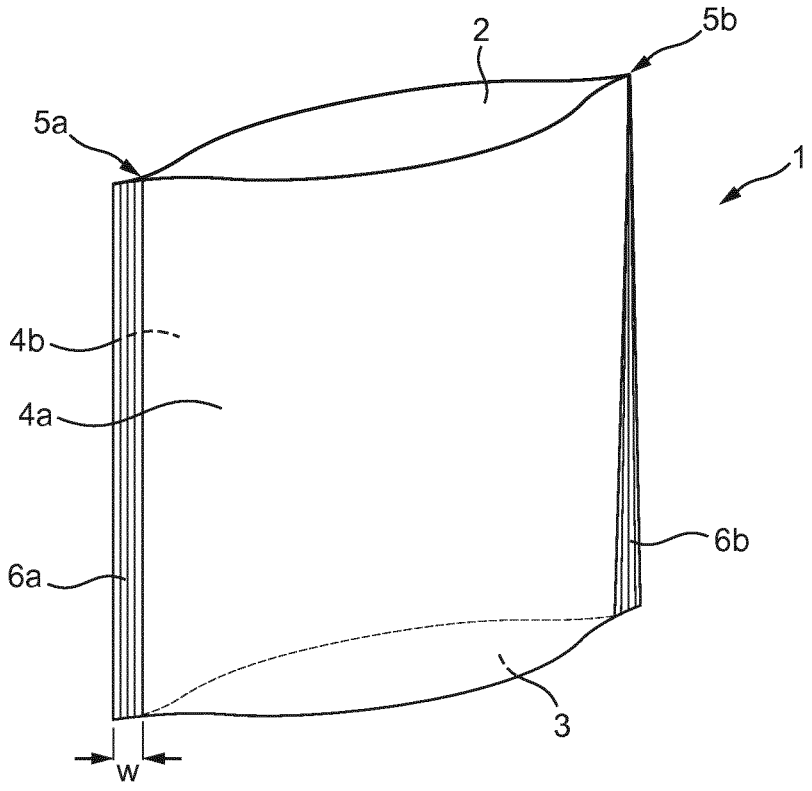
FIG. 1 is a three dimensional view showing schematically a flexible pouch according to the present invention, in an open position, having two side walls, two lateral folding lines and two lateral welding lines wherein one lateral welding line has a width that varies regularly along its length.

- 10A: a flexible pouch according to the invention, in a closed position, in a container which is adapted to receive the flexible pouch
- 10B: a flexible pouch according to the invention, in an open position, in a container which is adapted to receive the flexible pouch even when the pouch is open.

In the figures and/or description, the reference numbers correspond to the following technical features:

(1) flexible pouch
(2) opening of the flexible pouch
(3) bottom of the flexible pouch
(4) side wall of the flexible pouch
(5) lateral folding line of the flexible pouch=folding line found along the edge of the side wall (4) extending from the opening (2) to the bottom (3)
(6) lateral welding line
(7) interruption of the lateral welding line (6)
(8) shoulder
(9) gusset
(10) transversal welding line
(11) zip
(12) curved bottom
(13) skirt surrounding the bottom (3).
(14) container
(15) base of the container
(16) opening of the container
(17) side wall of the container
(18) lid of the container
(a) perimeter of the opening (2) of the flexible pouch (1)
(b) perimeter of the bottom (3) of the flexible pouch (1)
(c) distance between the opening (2) and the interruption (7) of the lateral welding line (6) of the flexible pouch (1)

(d) distance from the opening (2) to the bottom (3) of the flexible pouch (1)=length of the lateral folding line (5) of the flexible pouch (1)

(e) distance between the opening (2) and the shoulder (8) of the flexible pouch (1)

(f) perimeter of the base (15) of the container (14)

(g) perimeter of the opening (16) of the container (14)

(w) width of the lateral welding line (6) of the flexible pouch (1)

(w1) width near the bottom (3) of the lateral welding line (6) of the flexible pouch (w2) width near the opening (2) of the lateral welding line (6) of the flexible pouch

DETAILED DESCRIPTION OF SOME EMBODIMENTS OF THE INVENTION

The next paragraphs give the definition of some terms and expressions used in the present application.

A "pouch" is a package or a packaging having an enclosed volume that can comprise the content of the pouch. The content is a product, particularly a dried product, especially a dried food product. Non-limiting examples of dried food products include for instance all types of powdered or particulate products such as infant formula, infant cereals, soluble coffee, soluble coffee mixes, soluble tea, soluble chocolate powder for beverages, and any other powdered beverages; grocery products such as flour, oat flakes, breakfast cereals, sugar, rice, pasta, ground coffee, tea leaves; flaky products such as seasoning, or culinary powder.

A pouch with X side walls means a pouch having X lateral/vertical facings, i.e. the bottom wall is not taken into consideration for the calculation of the side walls.

A "flexible pouch" means a pouch which is made with at least a flexible material such as a plastic film, paper and/or aluminium. For example the flexible pouch can be made of polypropylene, polyethylene (PE), polyethylene terephthalate (PET), polybutylene, polyolefin, ethylene vinyl acetate, polyamides, polyvinyl chloride, ethylene vinyl alcohol, polyvinylidene chloride, polyvinyl alcohol, or the like. In a specific embodiment the flexible material is not made of cardboard. The pouch can be made of from a single or several sheets of flexible material. In a particular embodiment it is made from a single sheet of material. The sheet(s) can be laminated (layered), i.e. it/they can contain 2, 3, 4 or more layers. In a particular example the sheet of the flexible pouch is made of 3 layers, the external layer being PET or paper, the intermediary layer being aluminium and the internal one being PE. As the material is flexible, the pouch can be twisted or bended under the action of pressure, like the hand pressure.

In a specific embodiment, the flexible pouch is not a composite pouch of more than one material.

The flexible pouch is preferably produced by Vertical Form-Fill-Seal (VFFS) method. In this case the pouch is created from flexible material on reel stock. The material is folded and sealed around a metal tube. The product is introduced in the pouch trough the tube. In VFFS technology the final pouch is vertical. In addition, using the VFFS technology allows faster rate of production, simplier line set up and reduced production costs (less material waste . . . ).

The terms "greater", "larger" and "wider" can be used interchangeably in the present application.

The terms "shorter" and "smaller" can be used interchangeably in the present application.

By the term "stand-up" it is meant that that the pouch can remain upright by itself, e.g. without the aid of any external device or container.

The "bottom" or "bottom wall" of the pouch represents the base of the pouch, i.e. the face on which the pouch stands up.

The "opening" of the pouch represents the part which is generally opposite to the bottom, typically at the top of the pouch. It is a gap defined by the side walls and it allows getting access to the content of the pouch.

The expressions "the opening of the pouch is open", "the pouch is open" and "the pouch is in the open position" can be used interchangeably in the present application.

The expressions "the opening of the pouch is closed", "the pouch is closed" and "the pouch is in the closed position" can be used interchangeably in the present application.

In the context of the invention, an opening/a bottom/a base with a certain perimeter means an opening/a bottom/a base delimited by a certain perimeter.

In this present invention the term "perimeter" should be understood as the internal/interior perimeter (and not the external/exterior perimeter), that is to say the internal/interior circumference delimited by the opening or the bottom of the pouch. It therefore corresponds to the external limit of the enclosed volume of the pouch.

As used in the present application the "lateral folding lines" correspond to the folding lines which are along the edge of the side walls extending from the opening to the bottom. They are therefore found at the lateral extremity (or edge) of the side walls, between the opening and the bottom. The length of the lateral folding lines especially corresponds to the distance (d) from the opening to the bottom.

A "welding line" is a seam or a sealing. It is a line of a width (w) which is obtained by heatsealing (thermosealing), a gluing or the like. In a particular embodiment it is obtained by heatsealing. The pouch can be made by folding and sealing together some parts of a single sheet or of several sheets. In a particular embodiment, the pouch is obtained after folding and sealing together some parts of a single sheet. The skilled man would know how to make a welding line. By way of example, a welding line of a width (w) which is constant is typically made using a continuous movement welding machine such as an apparatus equipped of rolls or with a sealing jaw of regular shape. The temperature will be adapted depending on the materials of the pouch that are used. Depending on the desired rigidity, the welding line can be made of a succession of parallel lines (horizontal or vertical) or by crossed lines.

A welding line allows improving the stability of the flexible pouch.

In the present invention at least one of the lateral folding lines comprises a welding line of a width (w), which means that there is at least one "lateral welding line" of a width (w), i.e. there is at least one welding line which is located along at least one of the lateral folding lines. The expressions "at least one of these lateral folding lines comprising/comprises a welding line of a width (w)" and "at least one lateral welding line of a width (w)" can be used interchangeably.

In the present invention, at least one (i.e. a part or all) of the lateral welding lines of the flexible pouch have a width (w) which is not constant along its length, i.e. the width (w) of the lateral welding line can be varying, i.e. not constant along its length (i.e. between the bottom and the opening). By the expression "the lateral welding line has a width which is not constant along its length" it is meant that the width of the lateral welding line varies along its length. The variation of the width (w) can be regular (or proportional) or irregular (or random) along its length. The variation can also be due to an interruption of the lateral welding line (i.e. of the sealing) between the opening and the bottom, and at a certain distance from said opening. This means that the width of the lateral welding line becomes zero or close to zero at a certain stage. The expressions "one of the lateral welding lines is interrupted" and "one of the lateral welding lines has an interruption" should be understood similarly. The interruption can be sharp or there can be a short transition part e.g. by the presence of a curve of small size.

The skilled man would know how to make a lateral welding line having a varying width (w). By way of example, this can typically be made using an intermittent movement welding machine such as an apparatus equipped of a sealing jaw having an irregular shape. The shape of the sealing jaw will be adapted in view of the desired shape of the lateral welding line, so many configurations are possible. The temperature will be adapted depending on the materials of the pouch that are used.

The variation of the width (w) and the varying width (w) should also be understood similarly.

The "shoulders" are transversal lines located in the side walls that help to close the flexible pouch, especially by folding the top of the pouch. When the flexible pouch is manufactured, filled and closed, there are some shoulders that are generally near the opening of said pouch. The location of these lines can then vary (e.g. it can follow the decrease of the content of the pouch) when the flexible pouch is used, i.e. each time the consumers re-close the pouch by folding the side walls on themselves.

The expressions "kit", "kit of part" and "kit-of-part" can be used interchangeably in the present invention.

The expression "the container is adapted to receive said flexible pouch" means that the container and the pouch are mutually shaped so that the pouch fits tightly into the container. In a specific embodiment the container and the flexible pouch are mutually shaped so that the flexible pouch fits tightly into the container even when the pouch is open.

It is noted that the various aspects, features, examples and embodiments described in the present application may be compatible and/or combined together.

In addition, in the context of the invention, the terms "comprising" or "comprises" do not exclude other possible elements. In some particular embodiments the terms "comprising" or "comprises" also encompass the expressions "consisting of", "consists of", "consisting essentially of", "consists essentially of".

Some particular embodiments of the invention will now be described in more details with regard to the accompanying figures.

FIG. 1 shows a specific embodiment of the invention. It is a three dimensional view of a flexible pouch (1) in an open position, comprising an opening (2) with a perimeter (a), a bottom (3) with a perimeter (b). The perimeter (a) is larger than the perimeter (b). The flexible pouch (1) has an oval shape. It has two side walls (4*a*, 4*b*), two lateral folding lines (5*a*, 5*b*), both of them comprising a welding line (6). There are therefore two lateral welding lines (6): a lateral welding line (6*a*) of a width (w) and a lateral welding line (6*b*) of a width that varies regularly along its length. The decrease of the width of the welding line (6*b*) is proportional from the bottom (3) to the opening (2).

A varying embodiment can be the pouch of FIG. 1 which has two lateral folding lines but only one of them comprises a welding line (so for example the same FIG. 1 without the presence of 6*a*).

Figure 2:
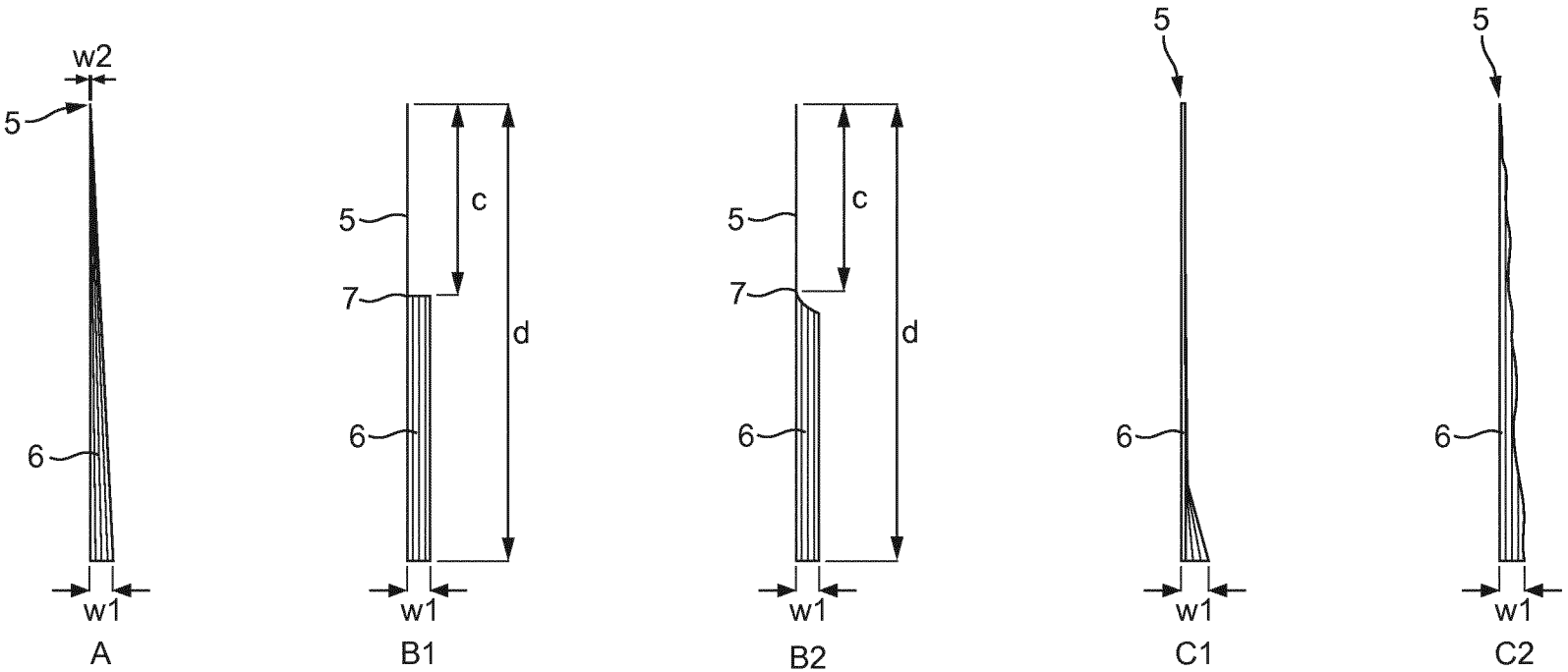
FIG. 2 are three dimensional views representing schematically some examples of different regular and irregular variations of the width of the lateral welding lines.

As previously mentioned, in particular embodiments of the present invention, at least one of the lateral folding lines (5) of the pouch (1) comprises a lateral welding line (6) of a width (w) that varies along its length. The variation of the width (w) of the lateral welding line (6) can be regular or irregular along its length. FIGS. 2 A, B and C represent some examples of regular and irregular variations of the width of the lateral welding lines (6). In these different figures, the lateral welding line (6) has a width (w1) near the bottom (3) which is larger than the width (w2) near the opening (2).

FIG. 2A represents a regular variation of the width of the welding line (6). There is a proportional decrease of the width of the welding line from the bottom (3) to the opening (2), like in FIG. 1.

FIG. 2B show some examples of interruption (7) of the welding line (6). This interruption (7) is located at a distance (c) from the opening (2). The distance "c" is shorter than the distance (d) which is the distance from the opening (2) to the bottom (3) of the flexible pouch (1). In these embodiments, "w2" is zero or close to zero. The interruption can be sharp as shown in FIG. 2B1 or there can be a short transition part made by a little curve as shown in FIG. 2B2.

FIG. 2C give some examples of irregular variations of the width of the welding line (6). The possibilities of irregular variations are of course very wide.

As previously mentioned, the number of side walls of the flexible pouch is variable. The pouch can have 2, 3, 4, 5, 6, 7, 8 or even more side walls. As previously explained, only a part (1, a quarter of them, a third of them, half of them, two thirds of them, three quarters of them . . . ) of the folding lines of the flexible pouch or all of them can comprise a welding line.

Figure 3:
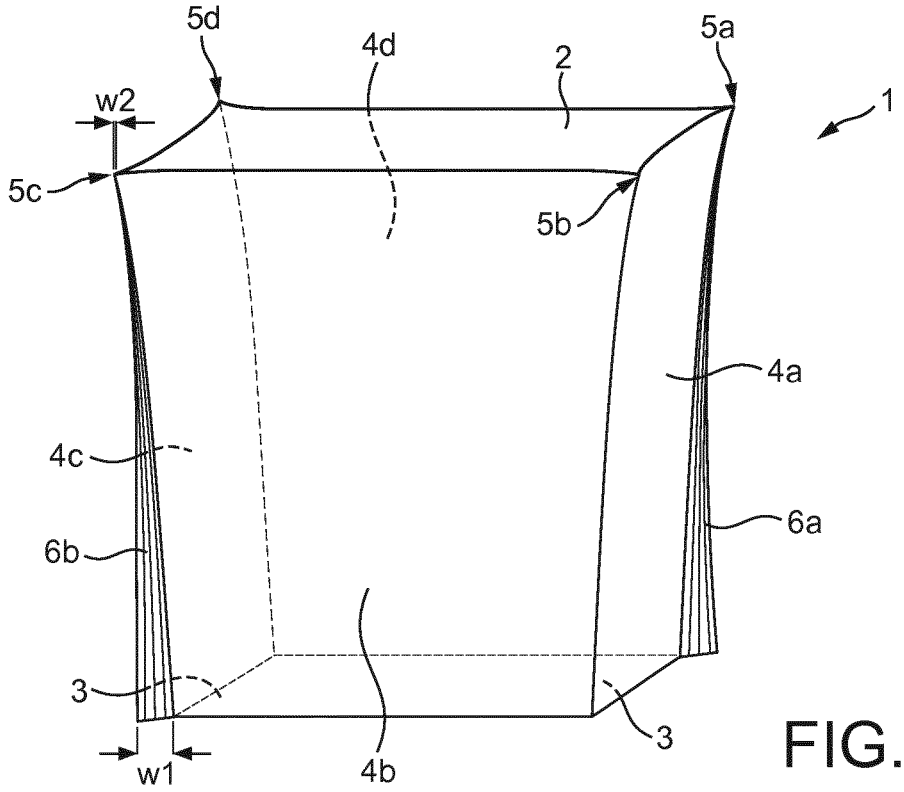
FIG. 3 is a three dimensional view showing schematically a flexible pouch according to the present invention, in an open position, having four side walls, four lateral folding lines and two lateral welding lines which have a width that varies regularly along their length.

FIG. 3 is a three dimensional view showing schematically a flexible pouch (1) in an open position, comprising an opening (2) with a perimeter (a), a bottom (3) with a perimeter (b). The perimeter (a) is larger than the perimeter (b). The flexible pouch (1) has four side walls (4*a*, 4*b*, 4*c*, 4*d*), four lateral folding lines (5*a*, 5*b*, 5*c*, 5*d*), half of them comprising a welding line (6). The two lateral welding lines (6*a*, 6*b*) have a width (w1) near the bottom (3) which is larger than the width (w2) near the opening (2). As previously mentioned, each of the lateral welding lines of the flexible pouch can have a similar or a different varying width. In the embodiment represented in FIG. 3, both lateral welding lines (6*a*, 6*b*) have a width that varies regularly along their length: the decrease of the width (w) of each welding lines (6*a*, 6*b*) is proportional from the bottom (3) to the opening (2).

As previously mentioned, in some embodiments of the invention, the flexible pouch can also have at least one lateral welding line with a width (w) that varies regularly along its length and at least one lateral welding line with a width (w) that varies irregularly along its length.

Figure 4:
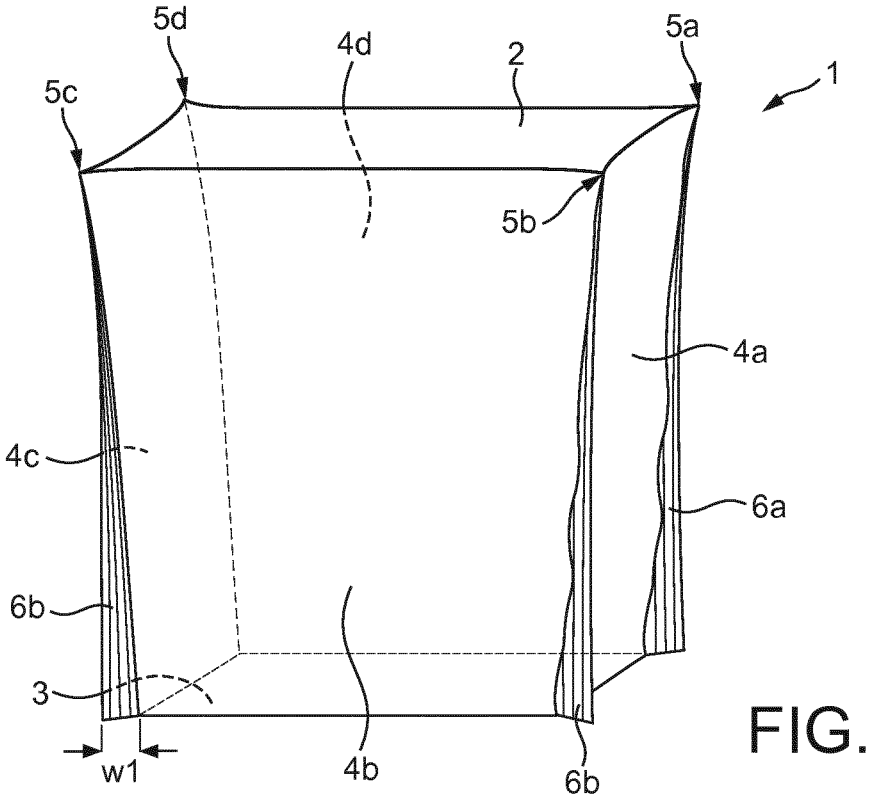
FIG. 4 is a three dimensional view showing schematically a flexible pouch according to the present invention, in an open position, said pouch having four side walls, four lateral folding lines and three lateral welding lines which have a width that varies either regularly or irregularly along their length.

FIG. 4 represents a three dimensional view of a flexible pouch (1) in an open position, comprising an opening (2) with a perimeter (a), a bottom (3) with a perimeter (b). The perimeter (a) is larger than the perimeter (b). The flexible pouch (1) has four side walls (4*a*, 4*b*, 4*c*, 4*d*), four lateral folding lines (5*a*, 5*b*, 5*c*, 5*d*), three quarters of them (i.e. three of them) comprising a welding line (6). The three lateral welding lines (6*a*, 6*b*, 6*c*) have a width (w1) near the bottom (3) which is larger than the width (w2) near the opening (2). But these three lateral welding lines (6*a*, 6*b*, 6*c*) have a width (w) that varies either regularly or irregularly along their length.

Figure 5:
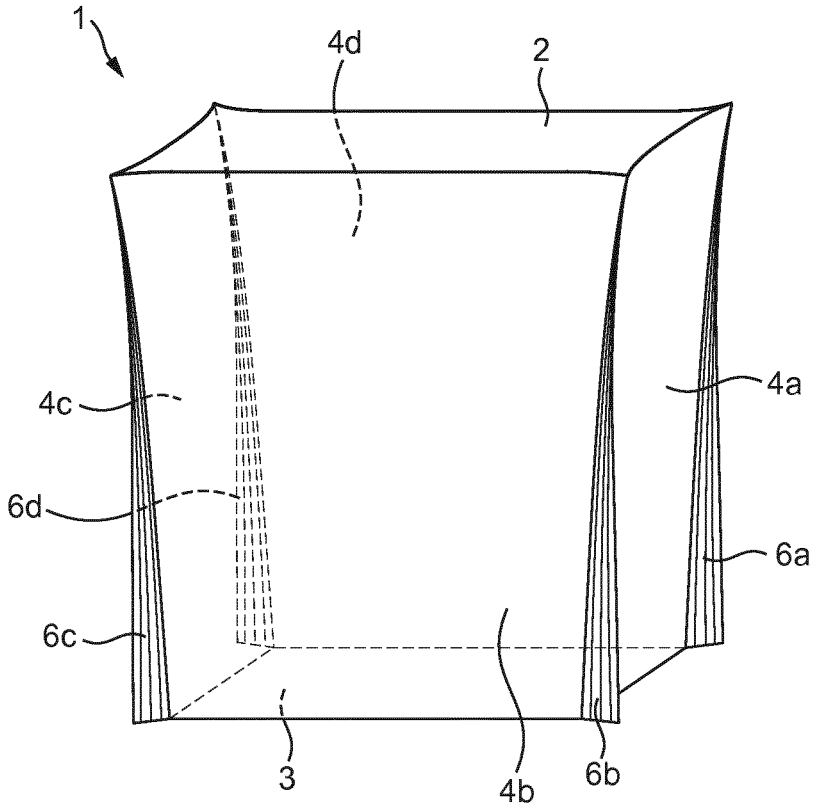
FIG. 5 is a three dimensional view showing schematically a flexible pouch according to the present invention, in an open position, having four side walls, four lateral folding lines and four lateral welding lines which have a width that varies regularly along their length.

The flexible pouch (1) represented in FIG. 5 is in an open position, it comprises an opening (2) with a perimeter (a), a bottom (3) with a perimeter (b), the perimeter (*a*) being larger than the perimeter (b). It has four side walls (4*a*, 4*b*, 4*c*, 4*d*), four lateral folding lines (5*a*, 5*b*, 5*c*, 5*d*), all of them comprising a welding line (6). The four lateral welding lines (6*a*, 6*b*, 6*c*, 6*d*) have a width (w1) near the bottom (3) which is larger than the width (w2) near the opening (2) and the variation of the width is regular along their length for all the four lateral welding lines (6*a*, 6*b*, 6*c*, 6*d*): the decrease of the width (w) of each welding lines (6*a*, 6*b*, 6*c*, 6*d*) is proportional from the bottom (3) to the opening (2).

Figure 6:
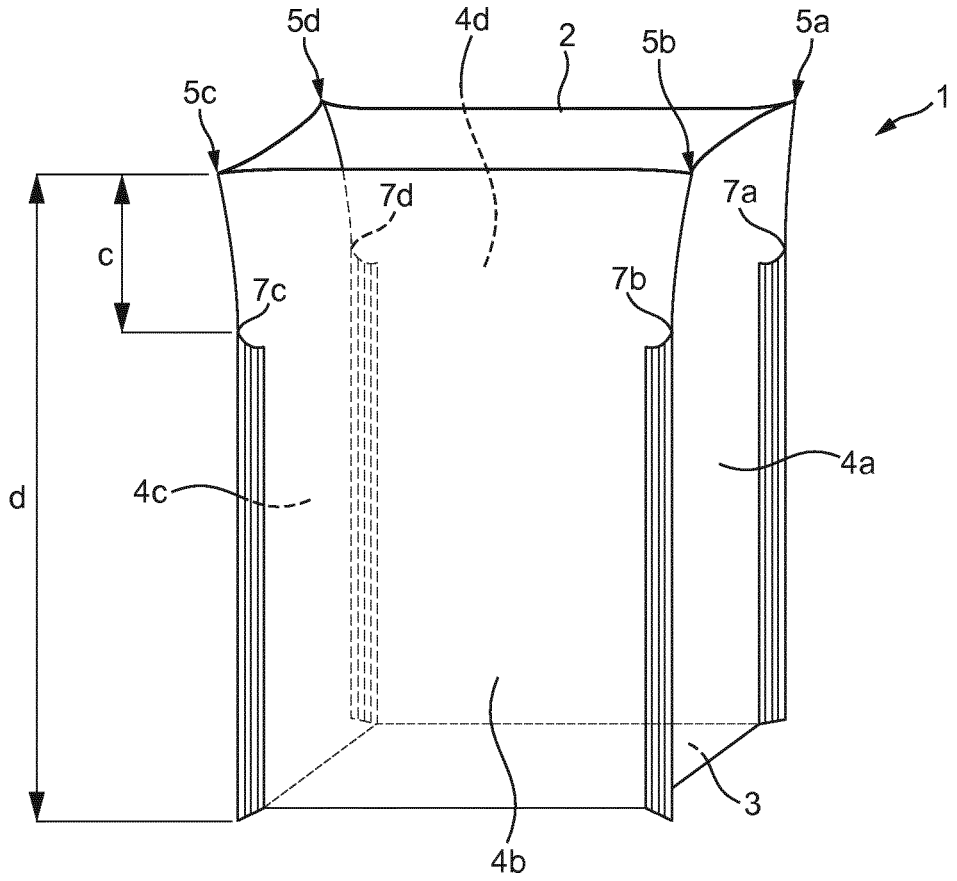
FIG. 6 is a three dimensional view showing schematically a flexible pouch according to the present invention, in an open position, having a funnel shape when open, said pouch having four side walls, four lateral folding lines and four lateral welding lines which are interrupted.

FIG. 6 is a three dimensional view of a flexible pouch (1) in an open position, comprising an opening (2) with a perimeter (a), a bottom (3) with a perimeter (b). The perimeter (a) is larger than the perimeter (b). It has four side walls (4*a*, 4*b*, 4*c*, 4*d*), four lateral folding lines (5*a*, 5*b*, 5*c*, 5*d*) and all of these lateral folding lines comprise a welding line (6). The four lateral welding lines (6*a*, 6*b*, 6*c*, 6*d*) are all interrupted: there is an interruption (7*a*, 7*b*, 7*c*, 7*d*) located at a distance (c) from the opening (2). In this particular embodiment all the distances (c) are similar. They are shorter than the distances (d) of the lateral folding lines (5*a*, 5*b*, 5*c*, 5*d*). This flexible pouch (1) has a funnel shape when it is open.

Figure 7:
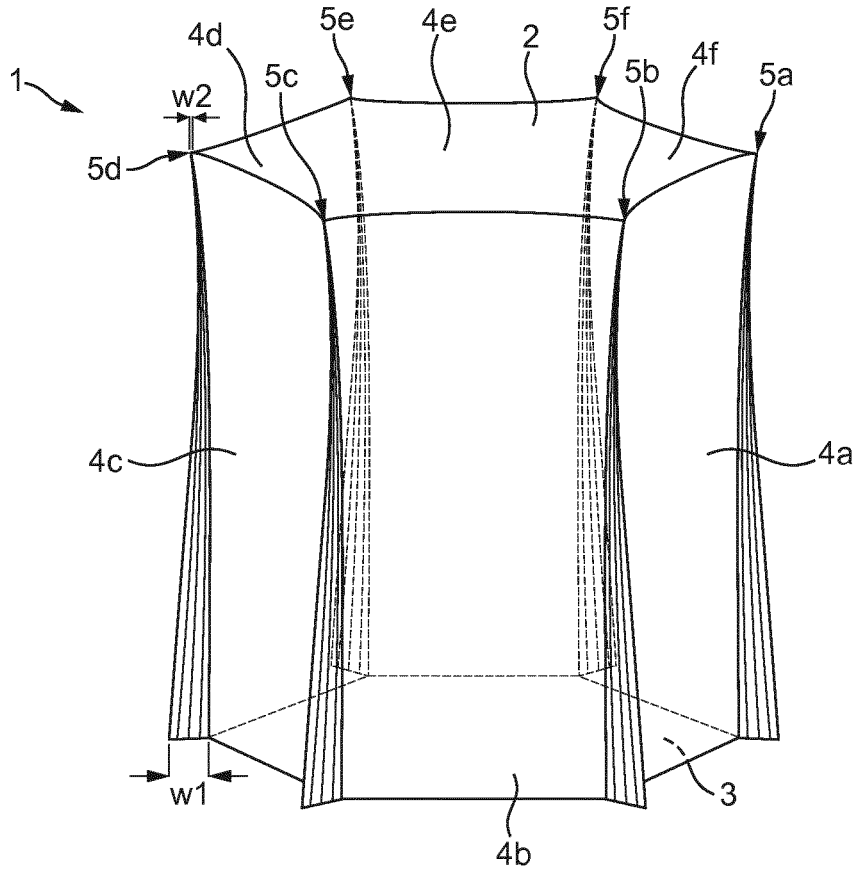
FIG. 7 is a three dimensional view showing schematically a flexible pouch according to the present invention, in an open position, having a conical shape, said pouch having six side walls, six lateral folding lines and six welding lines which have a width that varies regularly along their length.

FIG. 7 represents a three dimensional view of a flexible pouch (1) in an open position, comprising an opening (2) with a perimeter (a), a bottom (3) with a perimeter (b). The perimeter (a) is larger than the perimeter (b). The flexible pouch (1) has six side walls (4*a*, 4*b*, 4*c*, 4*d*, 4*e*, 4*f*), six lateral folding lines (5*a*, 5*b*, 5*c*, 5*d*, 5*e*, 5*f*), all of them comprising a welding line (6). The six lateral welding lines (6*a*, 6*b*, 6*c*, 6*d*, 6*e*, 6*f*) have a width (w1) near the bottom (3) which is larger than the width (w2) near the opening (2) and they have all a width that varies regularly along their length: the decrease of the width (w) of each welding lines (6*a*, 6*b*, 6*c*, 6*d*, 6*e*, 6*f*) is proportional from the bottom (3) to the opening (2).

This flexible pouch (1) has a conical shape when it is open.

Figure 8:
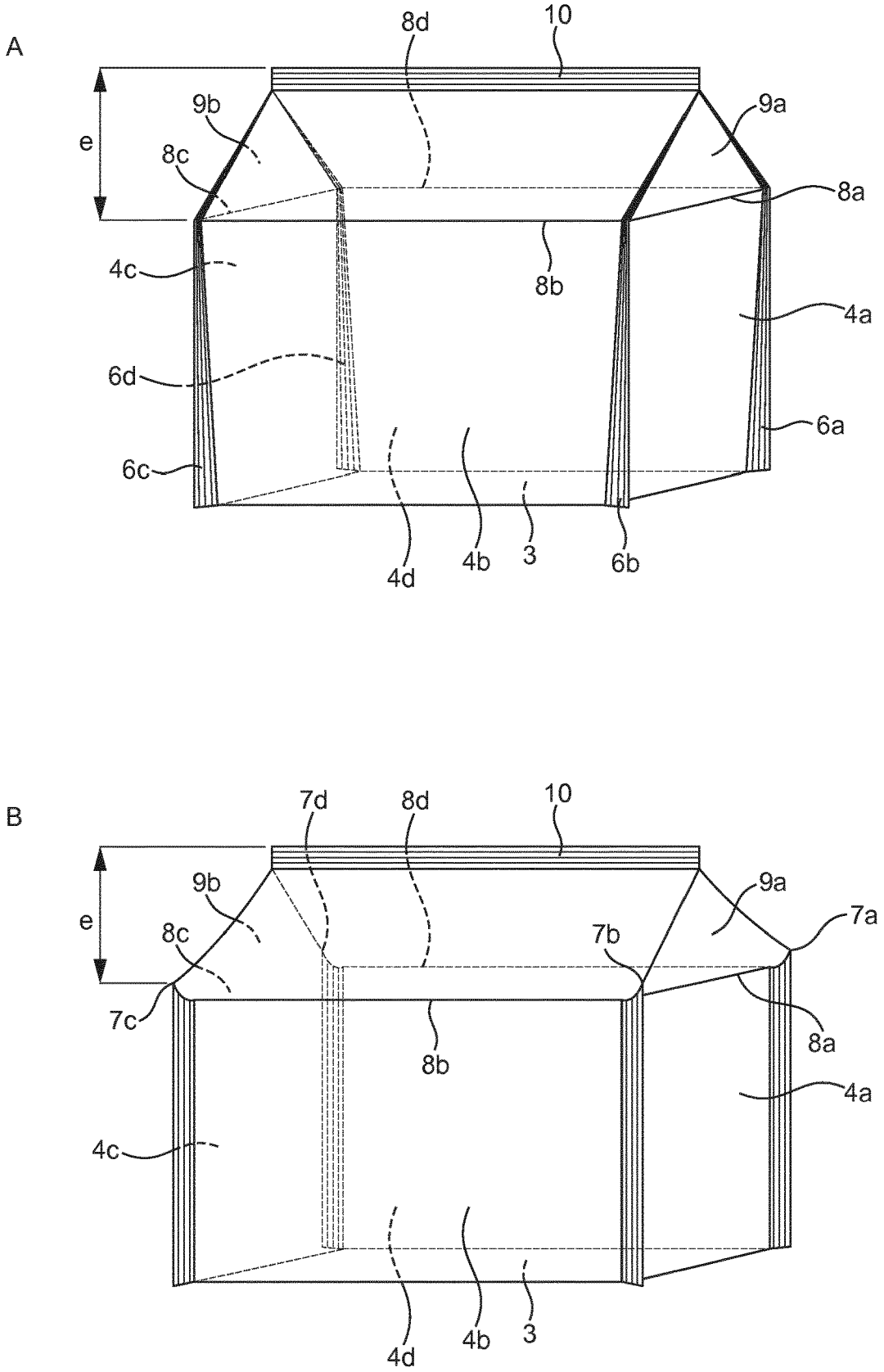
FIG. 8 are three dimensional views showing schematically a flexible pouch of the invention that is in closed position, the top of the flexible pouch is folded into a gusset and the flexible pouch is hermetically sealed via a transversal welding line.

As previously mentioned the opening of the flexible pouch may be closed or hermetically closed. Some examples are illustrated in FIGS. 8 and 9 that represent three dimensional views of a flexible pouch (1) in closed position.

FIG. 8A corresponds to the flexible pouch of FIG. 5 that is in closed position. It has four shoulders (8*a*, 8*b*, 8*c*, 8*d*) located at a distance (e) from the opening. The top of the flexible pouch (1) is folded to form two gussets (9*a*, 9*b*), i.e. the top of the side walls (4) are folded at the shoulders (8) and the flexible pouch (1) is hermetically sealed via a transversal welding line (10).

FIG. 8B corresponds to the flexible pouch of FIG. 6 that is in closed position. It has four shoulders (8*a*, 8*b*, 8*c*, 8*d*) located at a distance (e) from the opening and also the four lateral welding lines have four interruptions located at a distance (c) from the opening. The distance (e) corresponds to the distance (c). The top of the flexible pouch (1) is folded to form two gussets (9*a*, 9*b*), i.e. the top of the side walls (4) are folded at the shoulders (8) and the flexible pouch (1) is hermetically sealed via a transversal welding line (10).

Figure 9:
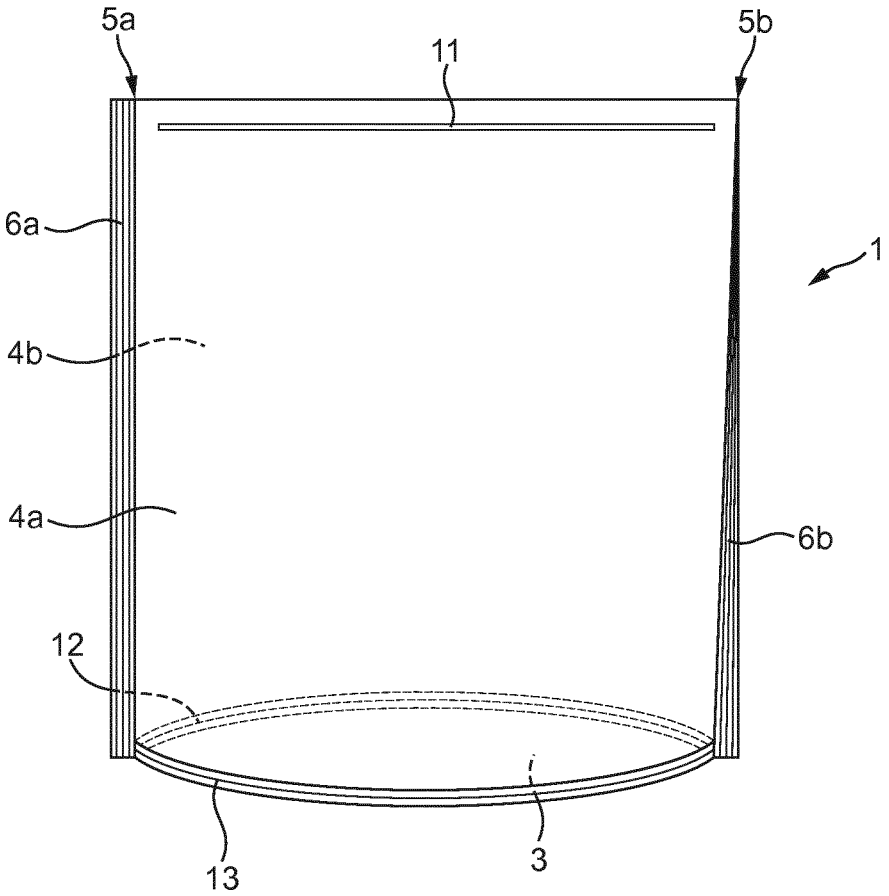
FIG. 9 is a three dimensional view showing schematically a flexible pouch of the invention that is in closed position, the flexible pouch being hermetically sealed via a zip.

In FIG. 9, the flexible pouch (1) corresponds to the flexible pouch of FIG. 1 that is hermetically sealed via a zip (11). In addition, it has a curved bottom (12) and a skirt (13) surrounding the bottom (3) to enhance its stability.

Figure 10:
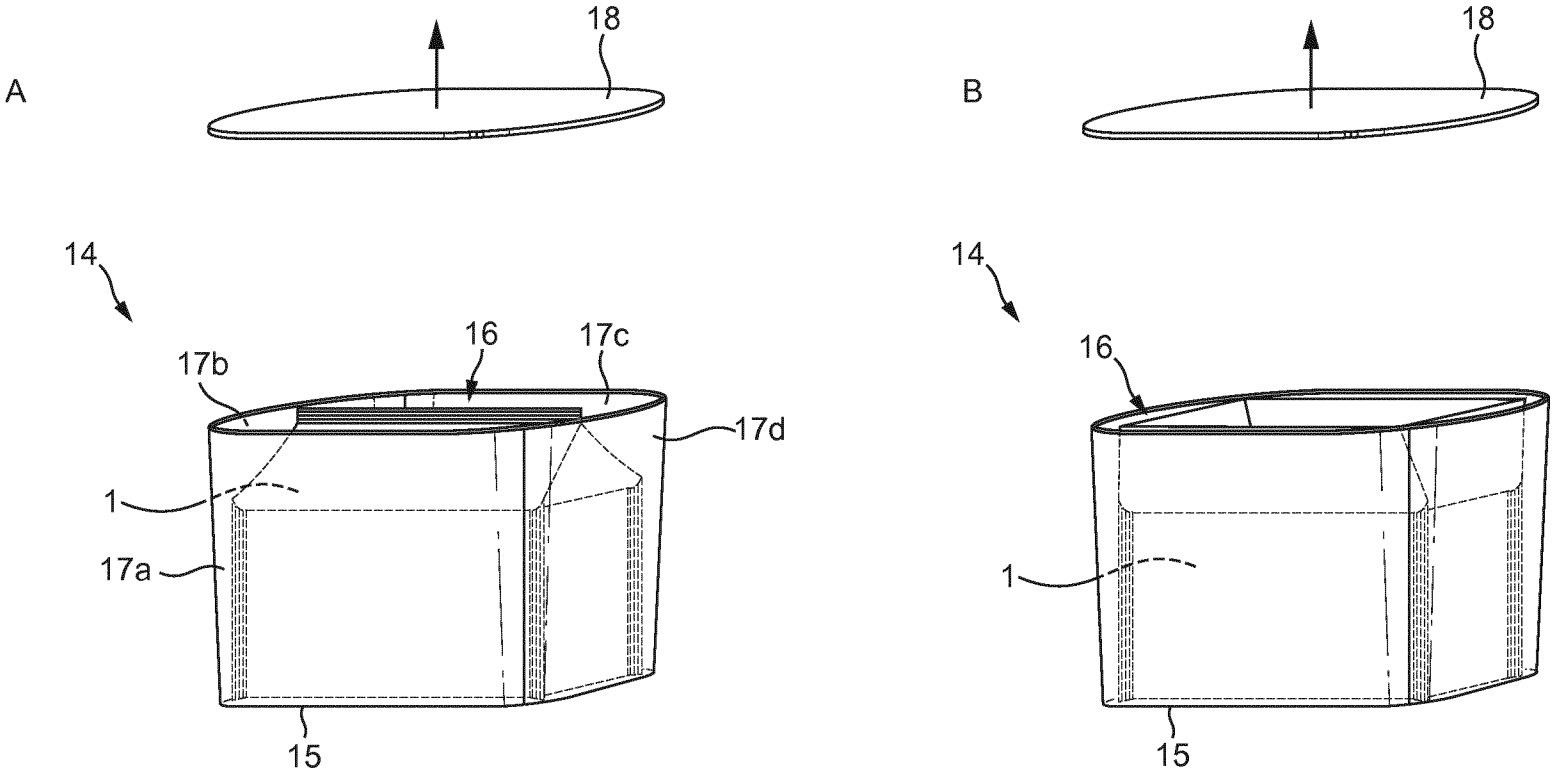
FIG. 10 are three dimensional views showing schematically a kit according to the present invention.

FIG. 10 are three dimensional views of a kit of the present invention. In FIG. 10A the flexible pouch (1) is in a closed position in a container (14) adapted to receive it. The container (14) comprises a base (15), an opening (16) and four side walls (17). It can be closed with a lid (18). The perimeter (f) of the base (15) of the container (14) is smaller than the perimeter (g) of the opening (16) of the container (14).

FIG. 10B illustrates an embodiment wherein the container (14) is adapted to receive the flexible pouch (1) even when the flexible pouch (1) is in an open position.

The invention claimed is:

1. A flexible pouch comprising:

an opening with a first perimeter;

a bottom with a second perimeter, a ratio of the first perimeter over the second perimeter is from 1.1 to 1.25;

at least two side walls; and at least two lateral folding lines, at least one of the at least two lateral folding lines comprising a lateral welding line, and the lateral welding line having a length and a first width near the bottom and a second width near the opening, the first width is greater than the second width.

2. The flexible pouch according to claim 1, comprising two side walls, two lateral folding lines, and two lateral welding lines.

3. The flexible pouch according to claim 1, comprising four side walls, four lateral folding lines, and four lateral welding lines.

4. The flexible pouch according to claim 1, comprising four lateral welding lines that include the lateral welding line, each of the four lateral welding lines having the first width near the bottom and a second width near the opening, the first width is greater than the second width.

5. The flexible pouch according to claim 1, wherein the lateral welding line is one of at least two lateral welding lines of the flexible pouch, each of the at least two lateral welding lines having the first width near the bottom and a second width near the opening, the first width is greater than the second width.

6. The flexible pouch according to claim 1, comprising at least one lateral welding line having a width that varies regularly or irregularly along the length of the at least one lateral welding line.

7. The flexible pouch according to claim 1, comprising at least one lateral welding line that has an interruption between the opening and the bottom at a distance from the opening.

8. The flexible pouch according to claim 1, further comprising at least two shoulders at a distance from the opening.

9. The flexible pouch according to claim 1, comprising four side walls, four lateral folding lines, four lateral welding lines, all of the four side walls, the four lateral folding lines, and the four lateral welding lines each having an interruption at a similar distance from the opening, and four shoulders located at the similar distance from the opening.

10. The flexible pouch according to claim 1, wherein the opening is closed with a closing member.

11. The flexible pouch according to claim 1, wherein the flexible pouch is a stand-up pouch.

12. The flexible pouch according to claim 1, wherein the bottom comprises a member that improves stability of the flexible pouch.

13. The flexible pouch according to claim 1, wherein the flexible pouch is manufactured by vertical form-fill-seal technology.

14. The flexible pouch according to claim 6, wherein the width of the at least one lateral welding line decreases proportionally from the bottom to the opening.

15. The flexible pouch according to claim 10, wherein the closing member is selected from the group consisting of a plurality of reclose strips, a sticker, and combinations thereof.

16. A kit comprising:

a flexible pouch comprising an opening with a first perimeter, a bottom with a second perimeter, at least two side walls, at least two lateral folding lines, at least one of the at least two lateral folding lines comprising a lateral welding line, a ratio of the first perimeter over the second perimeter is from 1.1 to 1.25, the lateral welding line having a length and a first width near the bottom and a second width near the opening, the first width greater than the second width; and a container comprising a container base having a third perimeter, a container opening having a fourth perimeter, at least two container side walls, the container is adapted to receive the flexible pouch.

17. The kit according to claim 16, wherein the container is adapted to receive the flexible pouch even when the flexible pouch is open.

18. The kit according to claim 16, wherein the third perimeter of the base of the container is smaller than the fourth perimeter of the opening of the container.

19. The kit according to claim 16, wherein the container opening can be closed or hermetically closed with a lid.

20. A method for storing and/or dispensing dried food products, the method comprising storing the dried food products in a flexible pouch, the flexible pouch comprising an opening with a first perimeter, a bottom with a second perimeter, at least two side walls, at least two lateral folding lines, at least one of the at least two lateral folding lines comprising a lateral welding line, a ratio of the first perimeter over the second perimeter is from 1.1 to 1.25, the lateral welding line having a length and a first width near the bottom and a second width near the opening, the first width greater than the second width defining a conical shape of the flexible pouch when the flexible pouch is open.

21. A method for providing access to a product stored in a flexible pouch, the method comprising storing the product in the flexible pouch, the flexible pouch comprising an opening with a first perimeter, a bottom with a second perimeter, at least two side walls, at least two lateral folding lines, at least one of the at least two lateral folding lines comprising a lateral welding line, a ratio of the first perimeter over the second perimeter is in a range from 1.1 to 1.25, the lateral welding line having a length and a first width near the bottom and a second width near the opening, the first width greater than the second width.

* * * * *